US008951167B2

(12) United States Patent
Chen

(10) Patent No.: US 8,951,167 B2
(45) Date of Patent: Feb. 10, 2015

(54) ANTI-DRIFT MECHANISM FOR TREADMILL

(75) Inventor: James Chen, Nantou County (TW)

(73) Assignee: Joong Chenn Industry Co., Ltd., Nantou, Nantou County (TW)

( * ) Notice: Subject to any disclaimer, the term of this patent is extended or adjusted under 35 U.S.C. 154(b) by 118 days.

(21) Appl. No.: 13/441,399

(22) Filed: Apr. 6, 2012

(65) Prior Publication Data

US 2013/0190140 A1 Jul. 25, 2013

(30) Foreign Application Priority Data

Jan. 20, 2012 (TW) ..... 101102520

(51) Int. Cl.

| | |
|---|---|
| ***A63B 22/00*** | (2006.01) |
| ***A63B 71/00*** | (2006.01) |
| ***A63B 22/02*** | (2006.01) |
| ***B65G 39/16*** | (2006.01) |

(52) U.S. Cl.

USPC ..... 482/54; 482/51; 198/806

(58) Field of Classification Search

USPC ..... 482/51, 54; 198/804, 806, 842

See application file for complete search history.

(56) References Cited

U.S. PATENT DOCUMENTS

| | | | | | |
|---|---|---|---|---|---|
| 2,007,910 | A | * | 7/1935 | Stephens | 198/813 |
| 3,082,858 | A | * | 3/1963 | King | 198/841 |
| 3,489,471 | A | * | 1/1970 | Kelley | 384/473 |
| 3,554,541 | A | * | 1/1971 | Seaman | 482/54 |
| 3,606,320 | A | * | 9/1971 | Erwin, Jr. | 82/7 |
| 3,731,917 | A | * | 5/1973 | Townsend | 482/4 |
| 3,980,174 | A | * | 9/1976 | Conrad | 198/835 |
| 4,006,816 | A | * | 2/1977 | Werntz | 198/781.04 |
| 4,049,328 | A | * | 9/1977 | Ouska et al. | 384/487 |
| 4,066,257 | A | * | 1/1978 | Moller | 482/54 |
| 4,204,673 | A | * | 5/1980 | Speer, Sr. | 482/5 |
| 4,342,452 | A | * | 8/1982 | Summa | 482/54 |
| 4,364,556 | A | * | 12/1982 | Otte | 482/4 |
| 4,374,587 | A | * | 2/1983 | Ogden | 482/54 |
| 4,410,082 | A | * | 10/1983 | McGinnis | 198/818 |
| 4,423,864 | A | * | 1/1984 | Wiik | 472/91 |
| 4,616,822 | A | * | 10/1986 | Trulaske et al. | 482/54 |
| 4,776,582 | A | * | 10/1988 | Ramhorst | 482/54 |
| 5,018,722 | A | * | 5/1991 | Whitmore | 482/54 |
| 5,302,162 | A | * | 4/1994 | Pasero | 482/54 |
| 5,320,589 | A | * | 6/1994 | Singleton et al. | 482/54 |
| 5,336,145 | A | * | 8/1994 | Keiser | 482/54 |
| 5,372,560 | A | * | 12/1994 | Chang | 482/54 |
| 5,385,520 | A | * | 1/1995 | Lepine et al. | 482/54 |
| 5,431,613 | A | * | 7/1995 | Singleton et al. | 482/54 |
| 5,509,872 | A | * | 4/1996 | Chen | 482/54 |
| 5,538,489 | A | * | 7/1996 | Magid | 482/54 |
| 5,599,259 | A | * | 2/1997 | Skowronski et al. | 482/54 |
| 6,010,432 | A | * | 1/2000 | Vawter | 482/54 |

(Continued)

*Primary Examiner* — Stephen Crow
*Assistant Examiner* — Garrett Atkinson
(74) *Attorney, Agent, or Firm* — Muncy, Geissler, Olds & Lowe, P.C.

(57) ABSTRACT

An anti-drift mechanism for a treadmill having a chassis, a support frame, and endless belt is mounted between a bottom side of the support frame and a lower half part of the endless belt includes a guide member and a pressing axial member sleeved onto the guide member. The guide member is mounted to the chassis of the treadmill and movable longitudinally with respect to the endless belt in such a way that the pressing axial member can be driven by the guide member to oppress the endless belt so as to increase the pressure applied to the endless belt for the purpose of adjusting the drifting belt back to its normal operational position.

9 Claims, 6 Drawing Sheets

(56) References Cited

U.S. PATENT DOCUMENTS

| | | | | |
|---|---|---|---|---|
| 6,042,514 | A * | 3/2000 | Abelbeck | 482/54 |
| 7,097,593 | B2 * | 8/2006 | Chang | 482/54 |
| 8,608,624 | B2 * | 12/2013 | Shabodyash et al. | 482/54 |
| 8,613,691 | B2 * | 12/2013 | Bosecker et al. | 482/54 |
| 2003/0073543 | A1 * | 4/2003 | Ota | 482/54 |
| 2004/0192512 | A1 * | 9/2004 | Kuo | 482/54 |
| 2005/0202936 | A1 * | 9/2005 | Ota | 482/54 |
| 2005/0209060 | A1 * | 9/2005 | Lull | 482/54 |
| 2006/0046904 | A1 * | 3/2006 | Chang et al. | 482/54 |
| 2006/0068978 | A1 * | 3/2006 | Moon et al. | 482/54 |
| 2007/0281832 | A1 * | 12/2007 | Alessandri et al. | 482/54 |
| 2010/0022358 | A1 * | 1/2010 | Schwaiger et al. | 482/54 |
| 2012/0184413 | A1 * | 7/2012 | Lo | 482/54 |

* cited by examiner

ANTI-DRIFT MECHANISM FOR TREADMILL

BACKGROUND OF THE INVENTION

1. Field of the Invention

The present invention relates generally to a treadmill, and more particularly, to an anti-drift mechanism for a treadmill.

2. Description of the Related Art

As a common fitness apparatus, the treadmill includes a front roller and a rear roller, which are mounted to a front end and a rear end of a support frame separately, an endless belt wound around the front and rear rollers, and a motor for driving rotation of the front roller to further drive the endless belt for circulatory rotation. In this way, the user can run on the endless belt for exercise and fitness.

In the process of operation, the endless belt is subject to drift toward one side because of the material it is made of and the junctions thereof in the process of its production. To improve this problem, most of the treadmills each have had an anti-drift mechanism so far for adjusting the position of the endless belt in time. However, to comply with the requirements of different users, some treadmills are equipped with a servomotor each for driving counterrotation of the endless belt to allow the user to walk backward on the endless belt in counterrotation to train the sense of equilibrium and different portions of muscles. However, the endless belt in counterrotation may be still subject to drift resulting from the same factor indicated above, but the anti-drift mechanism fails to calibrate the drift taking place in the process of the counterrotation of the endless belt, so the calibration of the endless belt becomes more difficult.

SUMMARY OF THE INVENTION

The primary objective of the present invention is to provide an anti-drift mechanism, which can calibrate an endless belt of a treadmill when the endless belt drifts and especially when the endless belt is in counterrotation.

The foregoing objective of the present invention is attained by the anti-drift mechanism composed of at least one guide member and at least one pressing axial member. The guide member is mounted to a chassis of the treadmill and movable longitudinally with respect to the endless belt. The pressing axial member is rotatably sleeved onto the guide member and can be driven by the guide member to oppress the endless belt for the purpose of adjusting the drifting belt back to its normal operational position.

Preferably, the guide member is one in number and has two ends, each of which is connected with a crossbar of the chassis via an adjustment assembly. Each of the adjustment assemblies includes a screw bolt and two screw nuts. Each of the screw bolts is threaded with a threaded hole of the guide member and is provided with a distal end inserted into a fastening hole of the crossbar. The two screw nuts of each adjustment assembly are threaded with the distal end of the screw bolt to hold the crossbar therebetween. In this way, the guide member can dangle with respect to the endless belt via the threaded connection with the screw bolt.

Preferably, the guide member is two in number and each of the guide members has one end connected with a crossbar of the chassis via an adjustment assembly. Each of the adjustment assemblies includes a screw bolt and two screw nuts. The screw bolt of each adjustment assembly is threaded with a threaded hole of one of the guide members and is provided with a distal end inserted into a fastening hole of the crossbar. The two screw nuts of each adjustment assembly are threaded with the distal end of the screw bolt of each adjustment assembly to hold the crossbar therebetween. In this way, each of the guide members is movable longitudinally with respect to the endless belt via the threaded connection with the screw bolts.

DETAILED DESCRIPTION OF PREFERRED EMBODIMENTS

Figure 1:
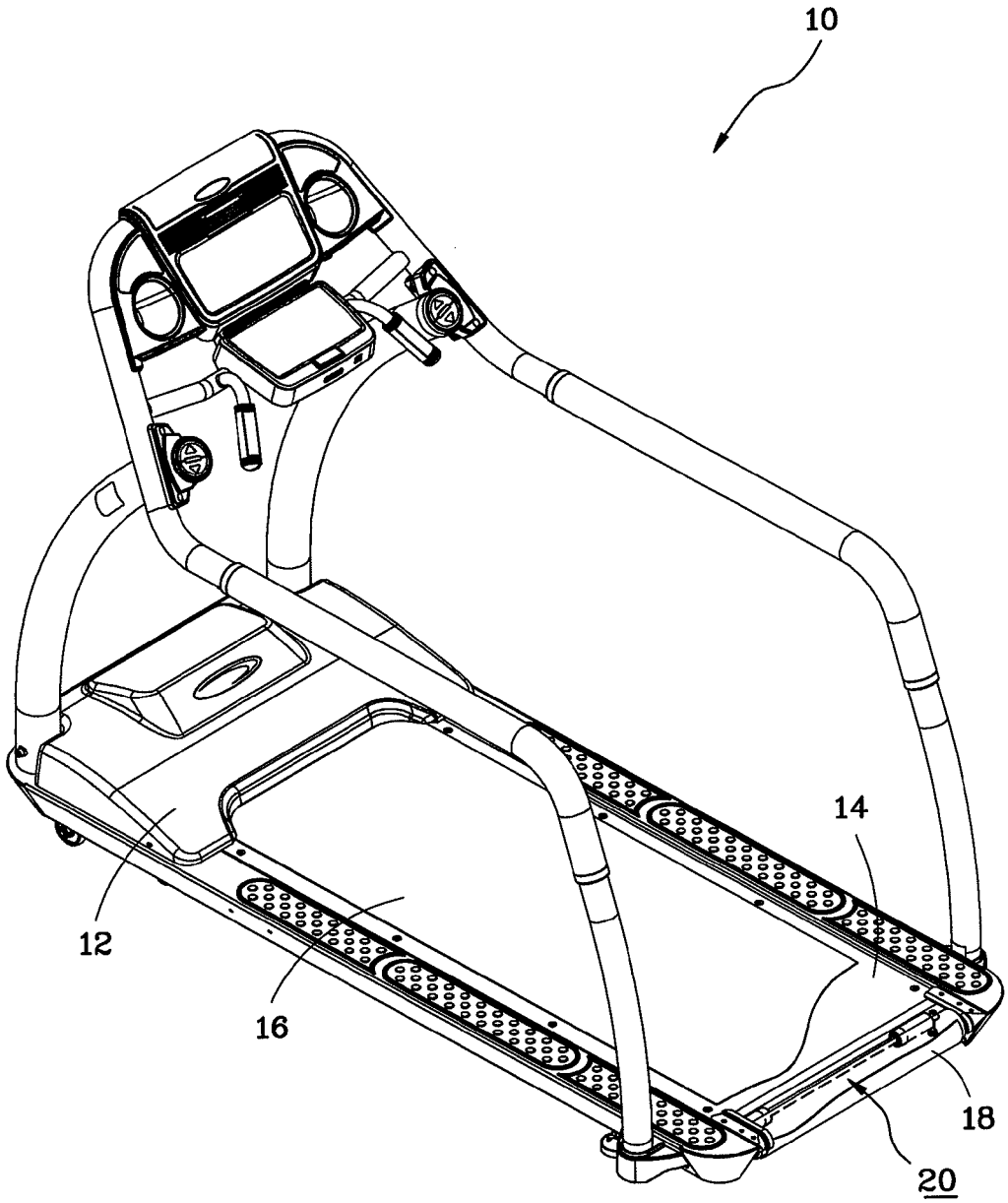
FIG. 1 is a perspective view of a treadmill in accordance with a first preferred embodiment of the present invention.
Figure 2:
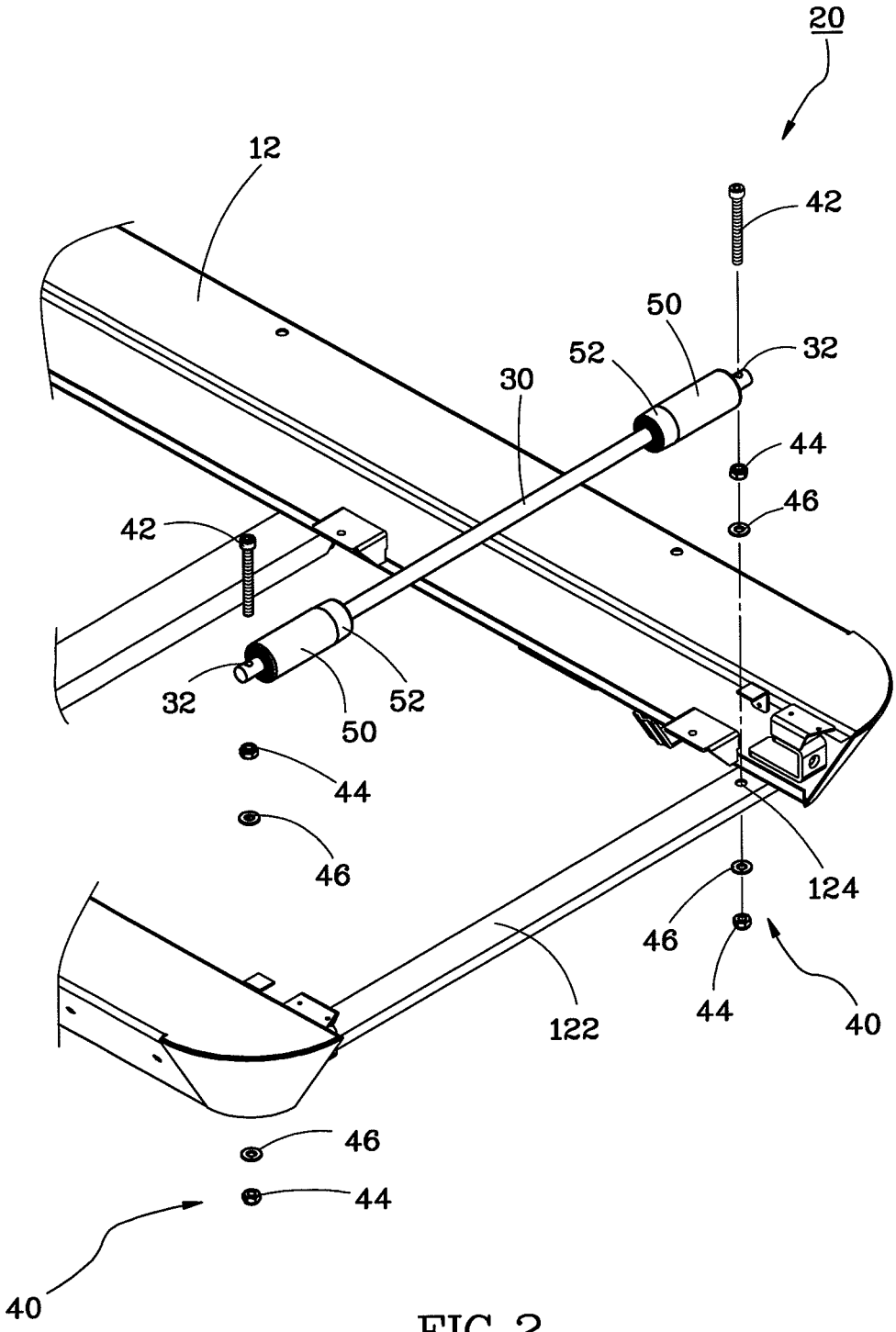
FIG. 2 is an exploded view of a part of the first preferred embodiment of the present invention.

Referring to FIG. 1, a treadmill 10 that an anti-drift mechanism 20 constructed according to a first preferred embodiment of the present invention is applied to is compose of a chassis 12, a support frame 14 mounted to the chassis 12, and an endless belt 16 wound around the support frame 14. The chassis 12 includes a crossbar 122 at a rear end. The crossbar 122 has two fastening holes 124, each of which is formed at one of two ends of the crossbar 122. As shown in FIG. 2, the support frame 14 includes a front roller (not shown) at a front end thereof and a rear roller 18 at a rear end thereof. The front roller can be driven by a servomotor (not shown) to drive the endless belt 16 for circulatory rotation around the support frame 14. Referring to FIG. 2 again, the anti-drift mechanism 20 is composed of a guide member 30, two adjustment assemblies 40, and two pressing axial members 50. The detailed descriptions and operations of these elements as well as their interrelations are recited in the respective paragraphs as follows.

Figure 3:
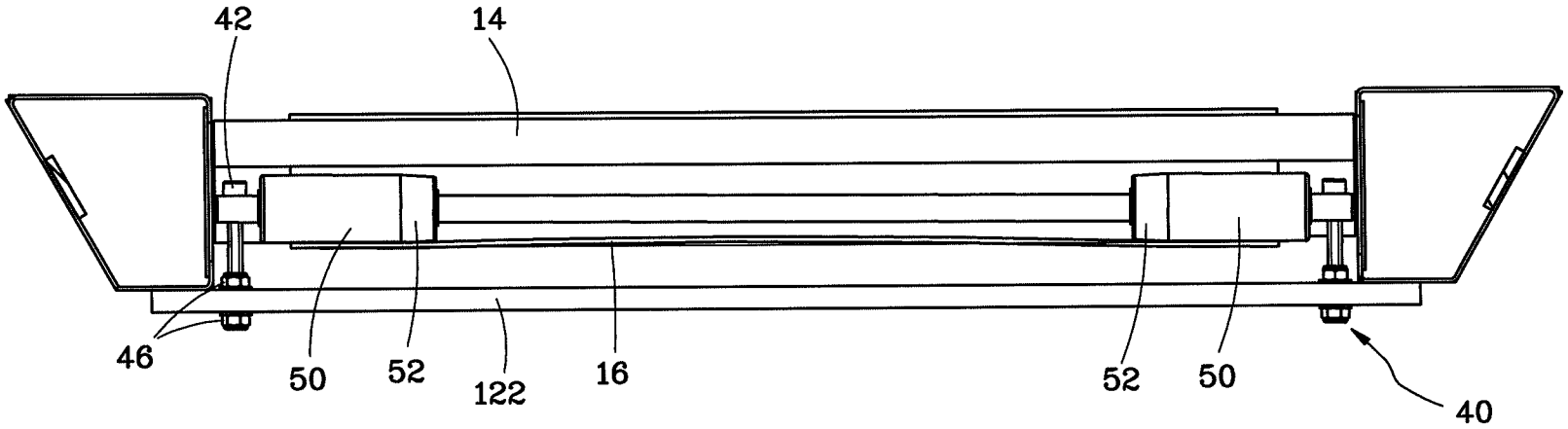
FIG. 3 is a side view of a part of the first preferred embodiment of the present invention.

The guide member 30 is one in number and located between a bottom side of the support frame 14 and a lower half part of the endless belt 16 and close to the rear roller 18. As shown in FIGS. 1 and 3, the guide member 30 includes two threaded holes 32, each of which is formed at one of two ends thereof and corresponds to one of the fastening holes 124, as shown in FIG. 2.

Each of the two adjustment assemblies 40 includes a screw bolt 42, two screw nuts 44, and two washers 46. Each of the screw bolts 42 is threaded with one of the threaded holes 32 and has a distal end inserted into one of the fastening holes 124 of the crossbar 122. The external diameter of the screw bolt 42 is smaller than the diameter of the fastening hole 124, so a gap is available between the distal end of the screw bolt 42 and the fastening hole 124 to allow the distal end of the screw bolt 42 to have space for movement. The two screw nuts 44 are threaded with the respective distal ends of the screw bolts 42 to hold the crossbar 122 therebetween. Each of the washers 46 is sleeved onto one of the screw bolts 42 and located between the screw nut 44 and the crossbar 122. In this way, the two ends of the guide member 30 can be longitudinally moved with respect to the endless belt 16 via the adjustment assemblies 40 to enable the guide member 30 to dangle with respect to the endless belt 16.

Each of pressing axial members 50 is rotatably sleeved onto one end of the guide member 30, keeps contacting the endless belt 16, and is forced by the dangle of the guide member 30 to oppress the endless belt 16. Each of the pressing axial members 50 includes a taper-shaped portion 52 formed at one end thereof away from the threaded hole 32 of the guide member 30. The cross-sectional area of each taper-shaped portion 52 becomes decreasing toward the threaded hole 32 from the pressing axial member 50 for preventing the pressing axial members 50 and the endless belt 16 from excessive friction therebetween resulting in damage to the endless belt 16.

Figure 4:
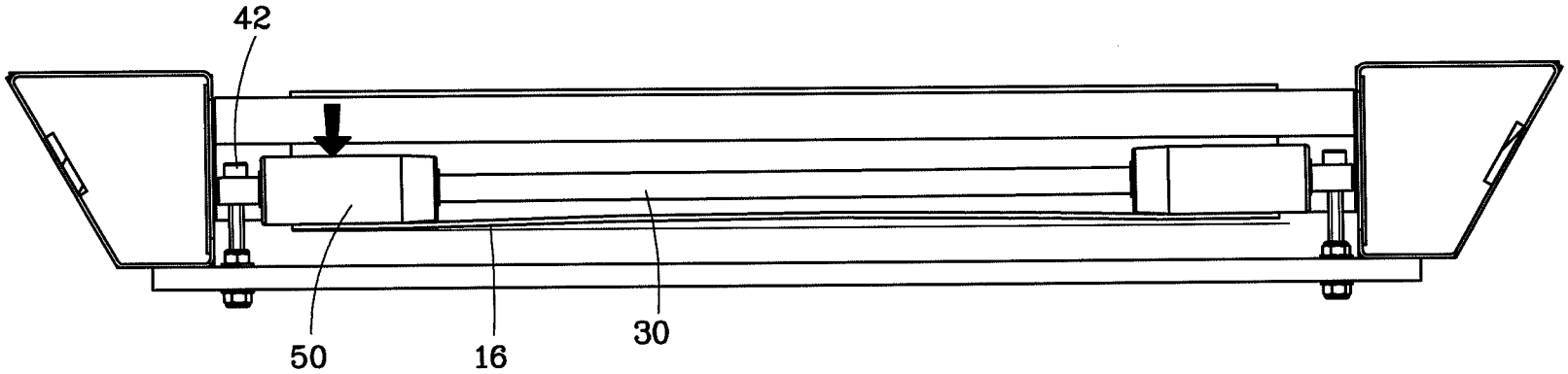
FIGS. 4 and 5 similar to FIG. 3 illustrate the first preferred embodiment of the present invention after calibration.
Figure 5:
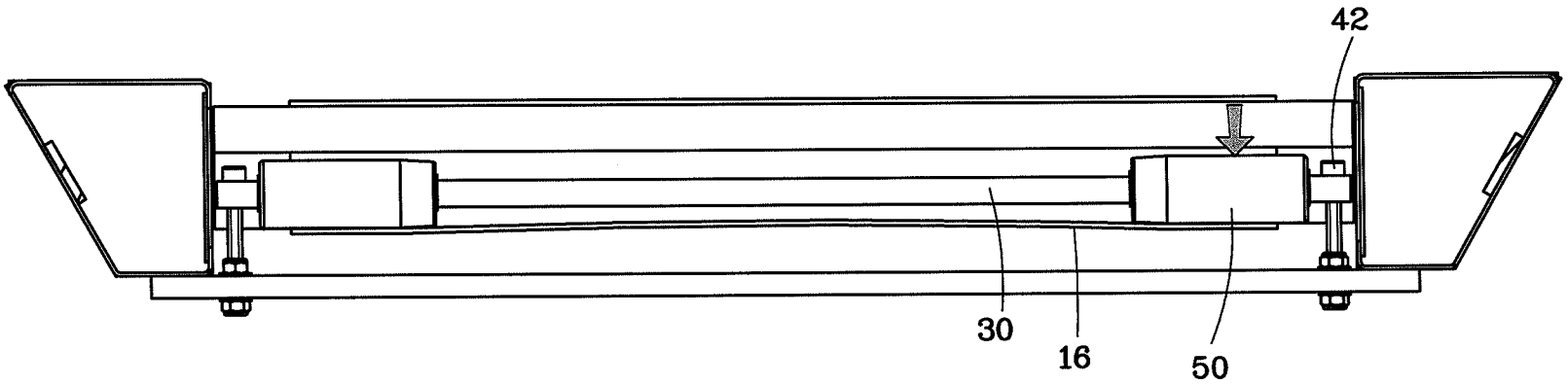

In light of the above structure, if the endless belt 16 drifts leftward in the process of counterrotation, the a tool like hexagonal wrench can be used for wrenching the screw bolt 42 located at the left side of the endless belt 16 counterclockwise to drive the left end of the guide member 30 to move downward toward the endless belt 16 through the threaded connection with the screw bolt 42; meanwhile, the pressing axial member 50 is moved downward along with the left end of the guide member 30 to oppress the left side of the endless belt 16 to increase the resistance against the left drift of the endless belt 16 in counterrotation to hold it at the normal operational position, as shown in FIG. 4. Similarly, if the endless belt 16 drifts rightward, rotate the screw bolt 42 at the right side of the endless belt 16 to drive the pressing axial member 50 along with the right end of the guide member 30 to oppress the right side of the endless belt 16 to increase the resistance against the right drift of the endless belt 16 in counterrotation for the purpose of calibration, as shown in FIG. 5.

Figure 6:
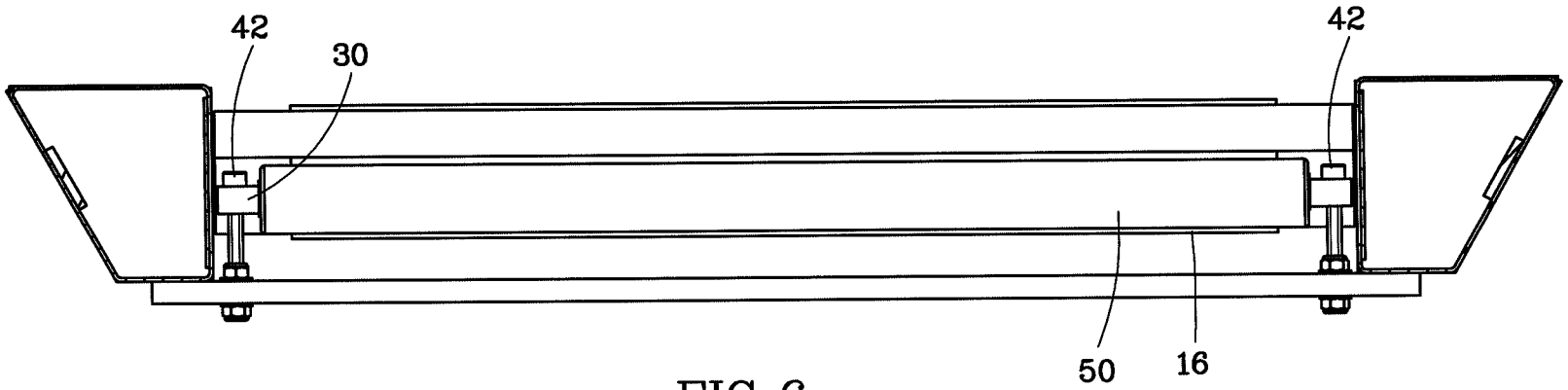
FIG. 6 is another side view of the same part of the first preferred embodiment of the present invention, illustrating that the pressing axial member is one in number.

Please be noted that the number of the pressing axial member 50 is not limited to two but at least one. Referring to FIG. 6, when it is intended to calibrate the drift of the endless belt 16, the user can also rotate one of the screw bolts 42 subject to the direction that the endless belt 16 drifts toward in counterrotation to drive the corresponding pressing axial members 50 along with the drift of the guide member 30 to oppress the endless belt 16 for the purpose of the calibration.

Figure 7:
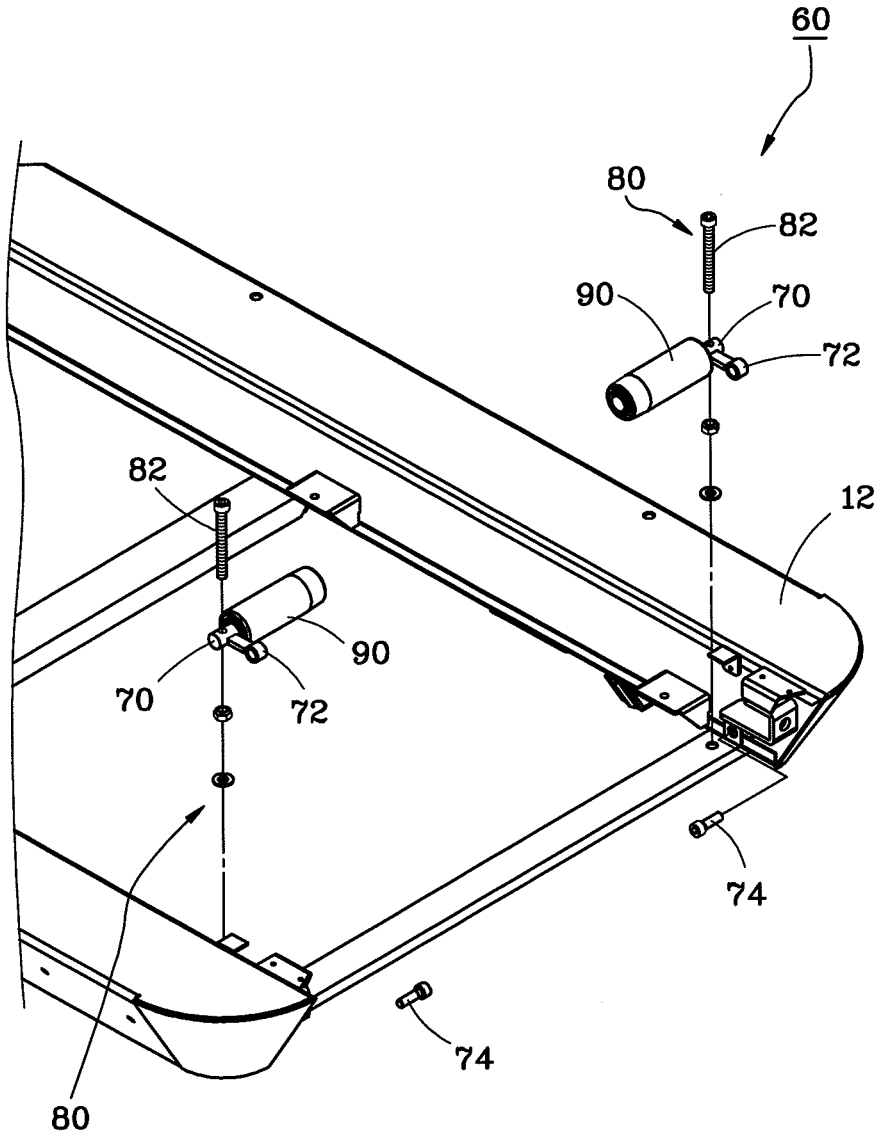
FIG. 7 is an exploded view of a part of a second preferred embodiment of the present invention.
Figure 8:
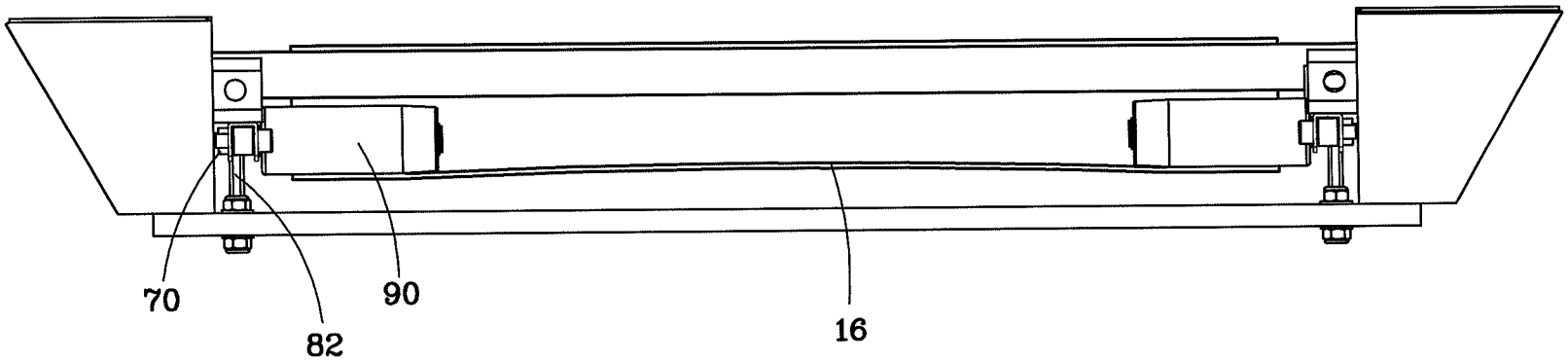
FIG. 8 is a side view of a part of the second preferred embodiment of the present invention.

Referring to FIG. 7, an anti-drift mechanism 60 constructed according to a second preferred embodiment of the present invention is composed of two guide members 70, two adjustment members 80, and two pressing axial members 90. The structural relationships among the guide members, the adjustment members 80, and the pressing axial members 90 are similar to those of the first embodiment, having the differences recited below. Each of the guide members 70 includes a support piece 72 radially extending from one end thereof. Each of the support pieces 72 has a distal end pivotably mounted to the chassis 12 of the treadmill 10 via a pivot pin 74 to strengthen the support of the guide member 70 structurally. In this way, as shown in FIG. 8, the user can rotate one of the screw bolts 82 subject to the direction that the endless belt 16 drifts toward, or rotate the two screw bolts at the same time, to drive one or two of the guide members 70 via the threaded connection with one or two of the screw bolts 82 to move downward toward the endless belt 16; meanwhile, one or two of the pressing axial members 90 increasingly oppress the endless belt 16 along with one or two of the guide members 70 for the purpose of adjusting the endless belt 16 to the normal operational position.

In conclusion, the anti-drift mechanism of the present invention can control the guide members for longitudinal movement by the simple coordination between the screw bolts and the threaded holes to force the pressing axial members to act along with the guide member for adjusting the drift of the endless belt in counterrotation. The whole operation is very simple and can effectively lower the difficulty of calibrating the endless belt in counterrotation to reach the objective of the present invention.

Although the present invention has been described with respect to specific preferred embodiments thereof, it is in no way limited to the specifics of the illustrated structures but changes and modifications may be made within the scope of the appended claims.

What is claimed is:

1. An anti-drift mechanism for a treadmill, the treadmill having a chassis including a crossbar at a rear end thereof, a support frame mounted to the chassis, a rear roller at the rear end thereof and an endless belt wound about the support frame, the anti-drift mechanism comprising:

at least one guide member, containing at least one threaded hole and being, located between a bottom side of the support frame and a lower half part of the endless belt and near the rear roller wherein the at least one guide member is connected with the chassis with at least one adjustment assembly having a screw bolt and two screw nuts, the screw bolt being threaded with the at least one threaded hole in the at least one guide member and having a distal end inserted into a fastening hole of the crossbar, the two screw nuts being threaded with the distal end of the screw bolt for holding the crossbar therebetween; and at least one pressing axial member rotatably sleeved onto the at least one guide member to be driven by the guide member to further oppress the endless belt in such a way that the endless belt can be adjusted to a normal operational position.

2. The anti-drift mechanism as defined in claim 1, wherein the at least one adjustment assembly is two in number and, wherein the at least one guide member is one in number and comprises two ends, each of the ends contains one of the threaded holes and is connected with the chassis via one of the adjustment assemblies.

3. The anti-drift mechanism as defined in claim 2, wherein the at least one pressing axial member is two in number and each of the pressing axial members is mounted to one of two ends of the guide member.

4. The anti-drift mechanism as defined in claim 3, wherein each of the pressing axial members comprises a taper-shaped portion formed at an end thereof away from the threaded hole, the cross-sectional area of each taper-shaped portion decreasing in a direction away from the threaded hole.

5. The anti-drift mechanism as defined in claim 2, wherein a diameter of each of the fastening holes of the crossbar is larger than an external diameter of the screw bolt.

6. The anti-drift mechanism as defined in claim 1, wherein the at least one adjustment assembly is two in number and, wherein the at least one guide member is two in number, each of the guide members having an end connected with the chassis of the treadmill via one of the adjustment assemblies.

7. The anti-drift mechanism as defined in claim 6, wherein each of the guide members comprises a support piece extending radially from an end thereof, each of the support pieces being pivotably mounted to the chassis of the treadmill via a pivot pin.

8. The anti-drift mechanism as defined in claim 6, wherein each of the pressing axial members comprises a taper-shaped portion formed at an end thereof away from the threaded hole, the cross-sectional area of each taper-shaped portion decreasing in a direction away from the threaded hole.

9. The anti-drift mechanism as defined in claim 1, wherein the at least one pressing axial member keeps contacting the endless belt.

* * * * *